US010395867B2

(12) United States Patent
Atchison

(10) Patent No.: US 10,395,867 B2
(45) Date of Patent: Aug. 27, 2019

(54) SELF REGULATING MECHANISM FOR STORAGE WATER HEATER

(71) Applicant: William Atchison, East Nassau, NY (US)

(72) Inventor: William Atchison, East Nassau, NY (US)

( * ) Notice: Subject to any disclaimer, the term of this patent is extended or adjusted under 35 U.S.C. 154(b) by 63 days.

(21) Appl. No.: 15/272,309

(22) Filed: Sep. 21, 2016

(65) Prior Publication Data

US 2018/0084607 A1 Mar. 22, 2018

(51) Int. Cl.
*H01H 35/18* (2006.01)
*H05B 1/02* (2006.01)

(52) U.S. Cl.
CPC ..... *H01H 35/18* (2013.01); *H05B 1/0283* (2013.01)

(58) Field of Classification Search
CPC .. H05B 1/0283; H05B 1/0269; H05B 1/0297; H05B 2203/021; H05B 1/0244; H05B 2203/005; H05B 2203/013; H05B 2203/017; H05B 2203/02; H01H 35/18; H01H 35/30; H01H 35/34
USPC ..... 392/451, 441, 485, 488, 454, 449, 450, 392/465, 471, 486, 498, 311, 314, 316, 392/324, 338, 390, 399, 401, 402, 405, 392/453, 455, 456, 457, 463, 464, 496, 392/500, 501
See application file for complete search history.

(56) References Cited

U.S. PATENT DOCUMENTS

| | | | | |
|---|---|---|---|---|
| 3,665,156 | A | 5/1972 | Lee | |
| 4,682,010 | A * | 7/1987 | Drapeau | A61M 16/1075 128/203.27 |
| 5,388,179 | A | 2/1995 | Boyd et al. | |
| 5,437,002 | A | 7/1995 | Bennett | |
| 5,442,157 | A | 8/1995 | Jackson | |
| 5,949,960 | A | 9/1999 | Hall | |
| 6,002,114 | A | 12/1999 | Lee | |
| 6,080,973 | A | 6/2000 | Thweatt | |
| 6,182,453 | B1 * | 2/2001 | Forsberg | B01D 5/0072 62/125 |
| 6,350,967 | B1 * | 2/2002 | Scott | G05D 23/1932 219/485 |
| 6,646,237 | B2 | 11/2003 | Liu | |
| 6,834,160 | B1 | 12/2004 | Chen-Lung et al. | |
| 8,068,727 | B2 | 11/2011 | Phillips et al. | |

(Continued)

*Primary Examiner* — Ibrahime A Abraham
*Assistant Examiner* — Chris Q Liu
(74) *Attorney, Agent, or Firm* — The Iwashko Law Firm, PLLC; Lev Ivan Gabriel Iwashko

(57) ABSTRACT

A self regulating mechanism for a storage water heater for preventing the operation of heating elements while the heating elements are not submerged comprises a liquid level switch and an electrical contactor which are each integrated with a storage water heater having at least a water tank, at least one heating element and thermostat pair, and an input voltage line. In operation, the electrical contactor is wired to selectively control the flow of electricity from the input voltage line to the thermostats and heating elements and the liquid level switch is operative to determine the water level and operate the switching of the electrical contactor based on whether the level of water in the water tank meets a predetermined threshold. As such, the electrical contactor will only permit electricity to flow to the heating element when the liquid level switch indicates that the water tank is substantially full.

4 Claims, 1 Drawing Sheet

(56) References Cited

U.S. PATENT DOCUMENTS

| | | | | |
|---|---|---|---|---|
| 8,791,393 | B2 | 7/2014 | Worden et al. | |
| 2013/0105002 | A1* | 5/2013 | Enos | B01L 7/02 137/334 |
| 2013/0193221 | A1* | 8/2013 | Buescher | F24H 9/2021 237/8 A |

* cited by examiner

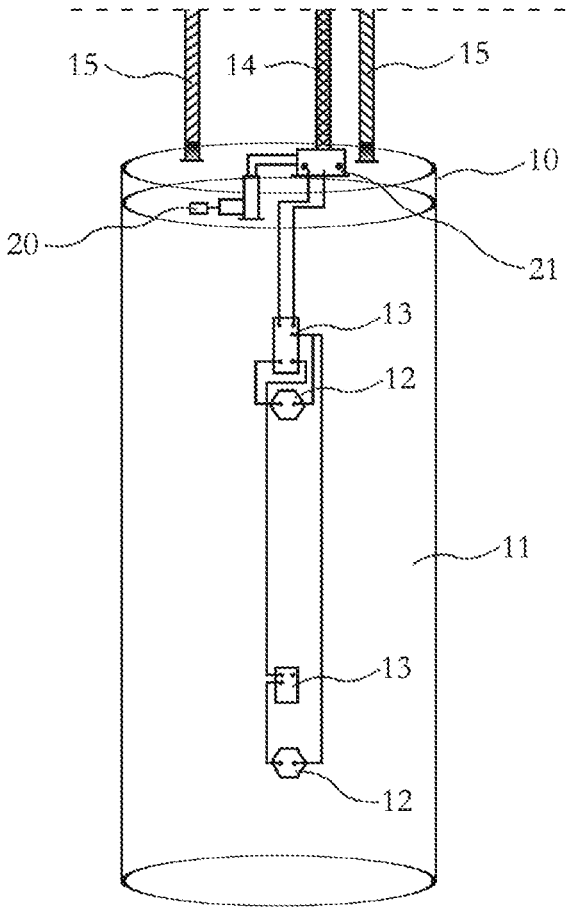
15
14
15
10
20
21
13
12
11
13
12

SELF REGULATING MECHANISM FOR STORAGE WATER HEATER

BACKGROUND OF THE INVENTION

Field of the Invention

This invention relates generally to heating devices and, more particularly, to a self regulating mechanism for a storage water heater which automatically controls heating coil operation based on the water level in the water storage tank.

Description of the Prior Art

The use and design of convention storage water heaters to provide the instantaneous delivery of hot water is well established. Such conventional storage water heaters generally operate by using a heating means driven by a fuel, such as electricity or propane, to heat water stored in a tank which then can be availed as desired through conventional plumbing or other means. A problem which still exists, however, is that for storage water heaters which employ a electrically driven heating means, such a heating means is subject to significant damage if operated without sufficient water in the tank. Furthermore, when installing or testing such a water heater, it is often difficult to ascertain the water level in the tank in order to know whether the heating means can be activated. Thus, there remains a need for a regulating mechanism for a storage water heater which automatically restricts the operation of heating element when the heating elements are not submerged in water. It would be helpful if such a self regulating mechanism for a storage water heater was integrated into the top of the storage water heater for ease of access. It would be additionally desirable for such a self regulating mechanism for a storage water heater to employ a liquid level switch which automatically interrupted the flow of electricity to the heating elements when the water in the tank fell below a preset threshold.

The Applicant's invention described herein provides for a regulating mechanism for a storage water heater adapted to control the flow of electricity to the heating elements of a storage water heater. The primary components in Applicant's self regulating mechanism are a liquid level switch and a contactor. When in operation, self regulating mechanism for a storage water heater effectively prevents the heating elements of a storage water heater from burning out. As a result, many of the limitations imposed by prior art structures are removed.

SUMMARY OF THE INVENTION

A self regulating mechanism for a storage water heater for preventing the operation of heating elements while the heating elements are not submerged. The self regulating mechanism comprises a liquid level switch and an electrical contactor which are each integrated with a storage water heater having at least a water tank, at least one heating element and thermostat pair, and an input voltage line. In operation, the electrical contactor is wired to selectively control the flow of electricity from the input voltage line to the thermostats and heating elements and the liquid level switch is operative to detect the level of water in the water tank and operate the switching of the electrical contactor based on whether the level of water in the water tank surpasses a threshold defined by the uppermost heating element in the water tank. In this regard, the electrical contactor will only permit electricity to flow to the heating element when the liquid level switch indicates that the water tank is substantially full.

It is an object of this invention to provide a need for a regulating mechanism for a storage water heater which automatically restricts the operation of heating element when the heating elements are not submerged in water.

It is another object of this invention to provide a self regulating mechanism for a storage water heater integrated into the top of the storage water heater for ease of access.

It is yet another object of this invention to provide a self regulating mechanism for a storage water heater that employs a liquid level switch which automatically interrupted the flow of electricity to the heating elements when the water in the tank fell below a preset threshold.

These and other objects will be apparent to one of skill in the art.

BRIEF DESCRIPTION OF THE DRAWINGS

FIG. 1 is a front perspective view of a storage water heater with a self regulating mechanism built in accordance with the present invention in an energizing position.

DETAILED DESCRIPTION OF THE INVENTION

Referring now to the drawings and in particular FIG. 1, a self regulating mechanism for a storage water heater 10 is shown as a liquid level switch 20 attached to the top of the inner water tank 11 of the storage water heater 10 and an electrical contactor 21 positioned on top of the storage water heater 10 housing. As with conventional electric water heaters, the storage water heater 10 includes the water tank 11, a plurality of heating elements 12, commonly defined as electrical coils, a thermostat 13 associated with each heating element, an input voltage line 14 which delivers electrical power from a source (generally a main electricity source), and hot and cold water lines 15.

In accordance with the self regulating mechanism of the instant disclosure, the electrical contactor 21 is wired to selectively control the flow of electricity from the input voltage line 14 to the thermostats 13 and heating elements 12. In this regard, by the operation of the electrical contactor 21, a circuit can be selectively made to allow electricity from the input voltage line 14 to the thermostats 13 and heating elements 12 and broken to interrupt to flow of electricity from the input voltage line 14 to the thermostats 13 and heating elements 12.

In one embodiment, a pair of indicator lights are disposed on the storage water heater 10. Such indicator lights, which may be positioned on the exterior of the housing of the electrical contactor 21, provide a visual indication of whether power is going to the contactor, and a separate visual indication of whether the tank 11 if full and energized. In one embodiment, the indicator lights define LED lights.

In one embodiment, this switching operation of the electrical contactor 21 is controlled by the operation of the liquid level switch 20. Specifically, the liquid level switch 20 is operative to detect the level of water in the water tank 11, specifically whether the water tank is full, and operate the switching of the electrical contactor 21 based on whether the level of water in the water tank 11 equals this threshold. It is contemplated that with the tank 11 full, the uppermost heating element 12 in the water tank 11 is guaranteed to be submerged. In this regard, the liquid level switch 20, which is mounted adjacent to the top of the water tank 11, is in its energizing position when its float is actuated to indicate the presence of the water level. On the other hand, the liquid level switch 20 is in its interrupting position when the float indicates a level of water beneath the top of the tank. In one embodiment, the liquid level switch 20 may define one of the L8 Series Flotect® Liquid Level Switches from Dwyer®. In alternate embodiments, an equivalent liquid level switch may be employed alternatively.

While in the energizing position, the liquid level switch 20 energizes the electrical contactor 21 to cause the electrical contactor 21 to make the circuit between the input voltage line 14 and the thermostats 13 and heating elements 12 and while in the interrupting position, the liquid level switch 20 causes the electrical contactor 21 to break the circuit between the input voltage line 14 and the thermostats 13 and heating elements 12.

In an alternate embodiment, an on/off float switch is employed with one two pole electrical contactor, with each electrical contactor associated with all of the thermostat and heating element pairs. In such an embodiment, the float switch has a lower threshold corresponding to the lowermost heating element and an upper threshold corresponding to the uppermost heating element and is operative to energize the electrical contactor corresponding to the lowermost heating element while the lower threshold is exceeded and/or energize the electrical contactors not until the upper threshold is exceeded.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A self regulating mechanism for a storage water heater, comprising:

a water tank to store water therein;

an electrical contactor disposed on top of the water tank, and connected with a input voltage line;

a liquid level switch directly and electrically connected to a first side of the electrical contactor in the water tank to energize the electrical contactor in response to the water in the water tank meeting a predefined threshold, such that the electrical contactor makes the circuit, and automatically interrupted the flow of electricity to the heating elements when the water in the tank fell below a preset threshold wherein the predefined threshold and preset threshold are levels of water in the water tank;

at least one heating element including an uppermost heating element and a lowermost heating element; wherein the uppermost heating element connected to a second side of the electrical contactor in the water tank, and configured to heat the water in response to receiving electricity from the electrical contactor, such that the at least one heating element is suspended in the water with an electrical wire;

at least two thermostats, and each of the at least two thermostats connected between one of the at least one heating element and the electrical contactor;

a first indicator light positioned on an exterior of a housing of the electrical contactor to provide a visual indication of whether power is going to the contactor;

a second indicator light positioned on the exterior of the housing of the electrical contactor to provide a separate visual indication of whether the tank is full of water and whether the tank is receiving electricity;

wherein the liquid level switch is operative to detect the level of water in the water tank and operate for switching of the electrical contactor based on whether the level of water in the water tank surpasses a predefined threshold defined by the uppermost heating element in the water tank;

wherein the electrical contactor is configured to selectively make and break a circuit to control the flow of electricity from the input voltage line to the thermostats and the at least one heating element, and control electricity to flow to the at least one heating element when the liquid level switch indicates that the water tank is full.

2. The self regulating mechanism of claim 1, wherein the electrical contactor is configured to selectively make and break a circuit which delivers electricity to the at least one heating element through being wired between an input voltage line and the at least one heating element.

3. A self regulating mechanism for a storage water heater, comprising:

a water tank to store water therein;

an electrical contactor disposed on at least a portion of a top surface of the water tank and connected with a input voltage line, wherein the electrical contactor is configured to selectively make and break a circuit to control the flow of electricity from the input voltage line to the thermostats and the at least one heating element;

a liquid level switch directly and electrically connected to the electrical contactor to detect whether water in the water tank meets a predefined threshold and energize the electrical contactor in response to the water in the water tank meeting the predefined threshold, such that the electrical contactor makes the circuit, said liquid level switch additionally configured to cause the electrical contactor to break the circuit automatically when the tank fell below a preset threshold, wherein the predefined threshold and the preset threshold are levels of water in the water tank;

at least one heating element including an uppermost heating element and a lowermost heating element; wherein the uppermost heating element connected to a second side of the electrical contactor in the water tank, and configured to heat the water in response to receiving electricity from the electrical contactor, such that the at least one heating element is suspended in the water with an electrical wire;

at least two thermostats, and each of the at least two thermostats connected between one of the at least one heating element and the electrical contactor;

a first indicator light positioned on an exterior of a housing of the electrical contactor to provide a visual indication of whether power is going to the contactor; and a second indicator light positioned on the exterior of the housing of the electrical contactor to provide a separate visual indication of whether the tank is full of water and whether the tank is receiving electricity wherein the liquid level switch is operative to detect the level of water in the water tank and operate for switching of the electrical contactor based on whether the level of water in the water tank surpasses a predefined threshold defined by the uppermost heating element in the water tank; and wherein the electrical contactor is configured to control electricity to flow to the at least one heating element when the liquid level switch indicates that the water tank is full.

4. The self regulating mechanism of claim 3, wherein the electrical contactor is configured to selectively make and break a circuit which delivers electricity to the at least one heating element through being wired between an input voltage line and the at least one heating element.

* * * * *